United States Patent [19]

Koepcke

[11] 4,059,208

[45] Nov. 22, 1977

[54] SKI AND POLE TOTE

[75] Inventor: Robert L. Koepcke, Onalaska, Wis.

[73] Assignee: Arro Corporation, La Crosse, Wis.

[21] Appl. No.: 666,896

[22] Filed: Mar. 15, 1976

[51] Int. Cl.[2] ..... A44B 21/00

[52] U.S. Cl. ..... 224/45 S; 24/815 K; 280/11.37 K

[58] Field of Search ..... 224/45 S, 45 R, 52; 280/11.37 C, 11.37 E, 11.37 K, 11.37 A; 248/226 E, 74 A; 211/60 SK; 24/73 SG, 81 SK

[56] References Cited

U.S. PATENT DOCUMENTS

| | | | |
|---|---|---|---|
| 3,564,667 | 2/1971 | Parrick et al. | 280/11.37 A X |
| 3,626,553 | 12/1971 | Darney et al. | 224/45 S X |
| 3,936,067 | 2/1976 | Link | 280/11.37 A |
| 3,976,234 | 8/1976 | Moudry et al. | 224/45 S |

FOREIGN PATENT DOCUMENTS

| | | | |
|---|---|---|---|
| 66,102 | 3/1942 | Norway | 280/11.37 C |
| 81,402 | 9/1934 | Sweden | 280/11.37 A |
| 220,516 | 8/1924 | United Kingdom | 248/226 E |

*Primary Examiner*—Robert J. Spar
*Assistant Examiner*—Donald W. Underwood
*Attorney, Agent, or Firm*—Carl M. Lewis

[57] ABSTRACT

A ski and pole tote is disclosed for carrying a pair of skis and ski poles. The tote uses a pair of resilient spring steel clasps of particular configuration for connecting the skis and poles. A modification of the invention is also shown.

9 Claims, 5 Drawing Figures

SKI AND POLE TOTE

BACKGROUND OF THE INVENTION

This invention relates to carriers and retaining apparatus and more particularly to ski and ski pole carriers of the portable type.

Various clips have been devised for clamping a pair of skis together such as shown in U.S. Pat. No. 3,683,462. Some of these devices have provision for additionally supporting a pair of ski poles such as shown in U.S. Pat. No. 3,892,343. Other variations disclose a pair of skis and ski poles supported by a pair of longitudinally spaced frames thereby permitting the skis and poles to be carried by one of the poles such as shown in U.S. Pat. No. 3,225,987. Relatively complex extruded plastic carriers have been devised for this purpose as will be seen in U.S. Pat. No. 3,893,606.

All of these aforementioned devices involve multiple parts or the use of complex machinery to manufacture thereby increasing their cost. They cannot be conveniently stored in a pocket while the skis and ski poles are in use.

SUMMARY OF THE INVENTION

The invention involves a ski tote involving a simple resilient clasp used in pairs for connecting skis and poles as a portable assembly. Each clasp is formed from a single flat spring steel strip. The clasp is lightweight, low in cost, and can easily be inserted into a pocket while the skis and poles are in use. The strip is curved in underslung relationship to the pair of skis and overslung relationship to the pair of ski poles.

Specifically this invention involves a ski and ski pole tote for simultaneously hand carrying a pair of skis arranged in generally parallel and horizontal, longitudinally coextensive relationship and along their minor transverse axis in bottom-to-bottom facing relationship and with their major transverse axis extending upwardly and a pair of generally parallel ski poles each spaced about the same distance above said pair of skis along said major transverse axis in longitudinally coextensive relationship with the pair of skis comprising: a pair of U-shaped clasps for connecting the skis and poles to be spaced longitudinally along the skis and ski poles and each clasp including a base portion positioned to extend along said minor transverse axis below the pair of skis, a first leg connected to one end of said base portion and positioned to extend adjacent the top face of one of the skis along said major transverse axis toward one of the poles, and a second leg connected to the other end of said base portion and positioned to extend adjacent the top face of the other of the skis along said major transverse axis toward the other of the poles, each of said legs terminating in a partially closed loop positioned to extend partially over and about the pole adjacent thereto, whereby said skis and ski poles may be toted as an assembly by hand grasping said ski poles intermediate said clasps.

DESCRIPTION OF THE DRAWINGS

A more complete understanding of the invention may be gained by reference to the drawings in which like reference numerals have been used to identify like structure throughout and in which.

DETAILED DESCRIPTION

Figure 1:
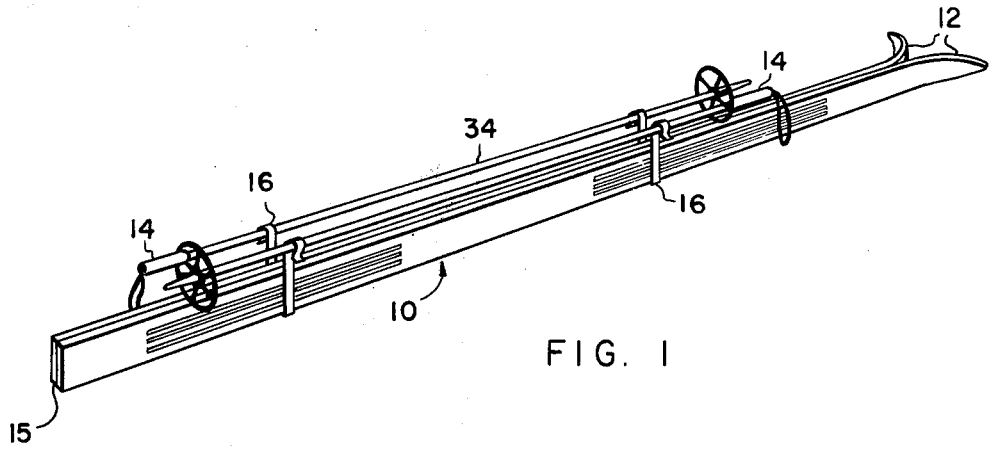
FIG. 1 is a perspective illustrating the manner in which the ski and pole clasps are used to connect a pair of skis and ski poles for toting.
Figure 2:
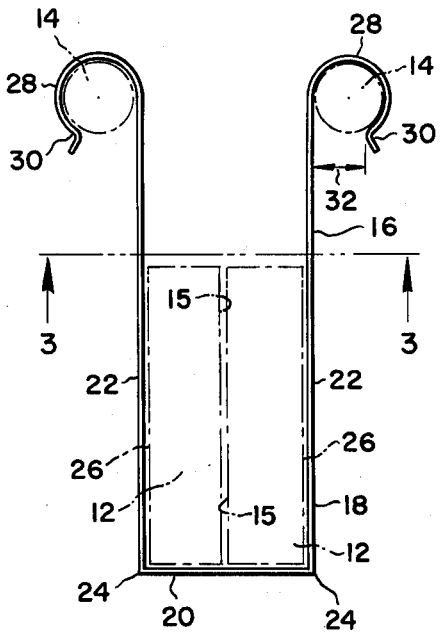
FIG. 2 is a front elevation of one of the ski and pole clasps illustrated in FIG. 1 particularly showing the curves bent therein.
Figure 3:
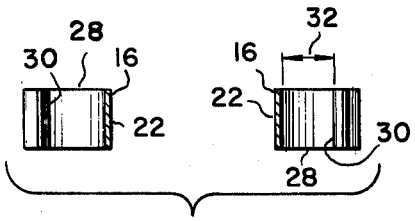
FIG. 3 is a sectional view of the ski and pole clasp illustrated in FIG. 2 viewed at line 3—3 in the direction indicated by the arrows.

Now referring to the preferred embodiment of the invention shown in FIGS. 1–3, it will be seen that a ski tote 10 is provided for a pair of skis 12 and a pair of ski poles 14.

The skis are positioned along their minor transverse axis, i.e., in the direction of their thickness, with their bottom faces 15 thereof directed inward each other. The skis are turned on their edge with their major transverse axis, i.e., in the direction of their width, directed upward. Carrying the skis in this attitude is particularly desirable for the skis are less likely to flex and work loose as a result of the motions of toting.

The ski poles are carried in side-by-side relationship above the skis. The poles are preferably directed in opposite directions so that the handle of one may be trapped in the ski pole basket of the other. The longitudinal axes of the poles and skis are generally parallel to each other.

The skis are supported from said poles by a pair of longitudinally spaced clasps 16. The portion of the poles 14 intermediate the clasps 16 may thus serve as a handle by grasping the poles with the hand as at 34.

Each clasp 16 is formed of a single flat strip 18 having a width of about one-half inch and made of springsheet steel having a thickness of about thirty mils. The strip is bent to have a generally U-shaped configuration including a base portion 20 about one and one-half inches long and extending parallel to the minor transverse axis of the skis in underslung relationship therewith.

It further has upwardly extending legs 22, each of which connect with an end 24 of the base portion and embraces the upper face 26 of one of the skis 12. The base portion is slightly longer than the thickness of the pair of skis. The bend at 24 between the base portion 20 and each leg 22 is made with a small radius in the order of less than about two times the thickness of the strip. The included angle of each of these bends is acute but close to a right angle when the clasp is in an unstressed condition so that the legs 22 will natrually converge toward each other from the base portion 20. The legs 22 become stressed upon placing the skis therebetween and will assume a position substantially as shown in the drawings.

Each leg 22 terminates at its upper end in an outwardly extending resilient partial loop 28 having a radius of about three-eighths inch about the longitudinal axis of one of the ski poles. The loop 28 is outwardly of the legs 22 and extends about 270 degree about an axis parallel to the major transverse axis of the strip 18 and terminates in a sharper oppositely curved terminal lip portion 30. The gap between the lip portion 30 and the leg 22 at 32 is smaller than the diameter of a ski pole 14 whereby the pole is releasably retained within the spring loop 28. Lip 30 facilitates insertion of the pole into the loop causing the loop to temporarily deform to permit the pole to snap into place. The loop then springs back to its original shape to retain the pole in position. The pole may be removed simply by forcing it downwardly through gap 32 in the reverse manner. The loop may be bent beyond its yield point to a slightly smaller or larger diameter by the individual user to accommodate his particular poles.

After the skis and poles are positioned in the clasps 16 as shown in FIG. 1 they may be carried as an assembly simply by grasping both poles 14 in a single hand at a point of balance as at 34.

Figure 4:
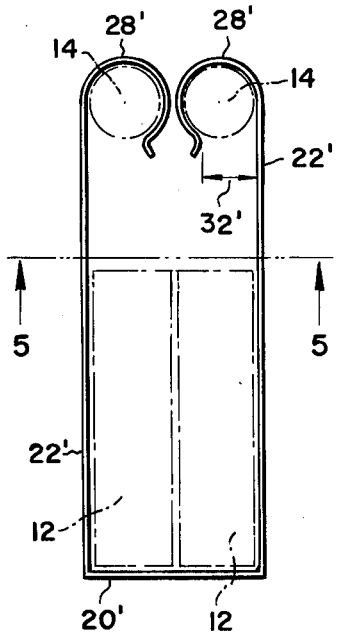
FIG. 4 is a front elevation similar to FIG. 2 of a first-modified form of the ski and pole clasp.
Figure 5:
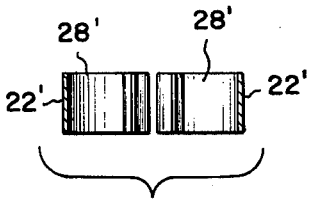
FIG. 5 is a sectional view of the modified ski and pole clasp shown in FIG. 4 viewed at line 5—5 in the direction indicated by the arrows.

The modification shown in FIGS. 4 and 5 is similar to that shown in FIGS. 2 and 3 except that the loops 28' are disposed inwardly of the legs 22'. Installation and removal of the skis 12 and poles 14 is similar except that it is necessary to spread the legs 22' to permit each pole to be brought to or from the area of the gap 32'.

It will thus be seen that my invention provides a tote for a pair of skis and poles which is extremely simple in construction, low in cost to manufacture, durable, lightweight, and sufficiently small to be conveniently carried on the person of the skier when not in use.

Having now described in detail two embodiments of my invention, it is contemplated that changes may be made without departing from the scope or spirit of my invention which is limited only by the claims.

I claim:

1. A ski and ski pole tote for simultaneously hand carrying a pair of skis arranged in generally parallel and horizontal, longitudinally coextensive relationship and along their minor transverse axis in bottom-to-bottom facing relationship and with their major transverse axis extending upwardly and a pair of generally parallel ski poles each spaced about the same distance above the pair of skis along said major transverse axis in longitudinally coextensive relationship with said pair of skis comprising: a pair of U-shaped clasps for connecting the skis and poles to be spaced longitudinally along the skis and ski poles and each clasp including a base portion positioned to extend along said minor transverse axis below the pair of skis, a first leg connected to one end of said base portion and positioned to extend adjacent the top face of one of the skis along said major transverse axis, to the one of said poles closest to said one ski, said first leg including a portion spanning the vertical spatial distance adjacent said first leg between the uppermost edge of said one ski and the lowermost edge of said one pole, and a second leg connected to the other end of said base portion and positioned to extend adjacent the top face of the other of the skis along said major transverse axis, to the other of said poles closest to said other ski, said second leg including a portion spanning the vertical spatial distance adjacent said other leg between the uppermost edge of said other ski and the lowermost edge of said other pole, each of said legs terminating in a partially closed single loop positioned to extend partially over and about the pole adjacent thereto, whereby said skis and ski poles may be toted as an assembly by hand grasping said ski poles intermediate said clasps.

2. The apparatus as defined by claim 1 wherein said loops are resilient to permit removal of the ski poles therefrom.

3. The apparatus as defined by claim 1 wherein said legs of each clasp are resilient and in their unstressed state are spaced apart a distance less than the length of said base portion to thereby yieldably press the skis together.

4. The apparatus as defined by claim 1 wherein each of said clasps is a resilient strip curved at said base portion and said loops portions about axes substantially parallel to its major transverse axis.

5. The apparatus as defined by claim 4 wherein said loops are curved about axes disposed inwardly of said legs.

6. The apparatus as defined by claim 5 wherein each of said loops terminates in a terminal lip portion curved opposite to the curve of said loop to thereby facilitate passage of the ski pole into said loop.

7. The apparatus as defined by claim 4 wherein said loops are curved about axes disposed outwardly of said legs.

8. The apparatus as defined by claim 7 wherein each of said loops terminates in a terminal lip portion curved opposite to the curve of said loop to thereby facilitate passage of the ski pole into said loop.

9. The apparatus as defined by claim 4 wherein said curve at said base portion includes two substantially right angle curves.

* * * * *